US007677562B2

(12) United States Patent
Ishihara et al.

(10) Patent No.: US 7,677,562 B2
(45) Date of Patent: Mar. 16, 2010

(54) RECORDING MEDIUM TRANSPORT DEVICE, RECORDING DEVICE, AND LIQUID EJECTING APPARATUS

(75) Inventors: Kenjiro Ishihara, Shiojiri (JP); Kazuo Saito, Shiojiri (JP); Kohei Ueno, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 110 days.

(21) Appl. No.: 11/951,805

(22) Filed: Dec. 6, 2007

(65) Prior Publication Data

US 2008/0143035 A1 Jun. 19, 2008

(30) Foreign Application Priority Data

Dec. 8, 2006 (JP) ..... 2006-331564

(51) Int. Cl.
*B65H 5/02* (2006.01)

(52) U.S. Cl. ..... 271/272; 271/273

(58) Field of Classification Search ..... 271/272, 271/273, 10.11, 265.01
See application file for complete search history.

(56) References Cited

U.S. PATENT DOCUMENTS 5,947,470 A * 9/1999 Fernandez ..... 271/272
6,241,243 B1 * 6/2001 Ishida et al. ..... 271/258.01
7,281,791 B2 * 10/2007 Anami et al. ..... 347/104
7,429,042 B2 * 9/2008 Ban et al. ..... 271/274
7,523,933 B2 * 4/2009 Linder et al. ..... 271/274
2007/0045944 A1 * 3/2007 Ban et al. ..... 271/272
2007/0075484 A1 * 4/2007 Terada ..... 271/258.01
2007/0102873 A1 * 5/2007 Acton et al. ..... 271/273

FOREIGN PATENT DOCUMENTS

JP 2005-008343 1/2005

* cited by examiner

*Primary Examiner*—Kaitlin S Joerger
(74) *Attorney, Agent, or Firm*—Workman Nydegger

(57) ABSTRACT

A paper guide up unit pivotally supporting a transport driven roller making contact with a transport driving roller is provided so as to be able to be displaced by the rotation of cams. The angle α made by a straight line passing the rotation axis line position of the transport driving roller and the rotation axis line position of the transport driven roller when viewed from the paper transport pathway side and a straight perpendicular to the paper transport direction is changed by the displacement of the paper guide up unit. Control means for controlling the displacement operation of the paper guide up unit reduces the angle α before the paper back end is passed through the nip point of the transport driving roller and the transport driven roller.

6 Claims, 8 Drawing Sheets

RECORDING MEDIUM TRANSPORT DEVICE, RECORDING DEVICE, AND LIQUID EJECTING APPARATUS

BACKGROUND

1. Technical Field

The present invention relates to a recording medium transport device for transporting a recording medium in a recording device, and a recording device and a liquid ejecting apparatus equipped with the same.

Herein, the liquid ejecting apparatus is not limited to a recording device such as a printer, a copier, a facsimile, or the like in which an ink jet type recording head is used and for performing recording on a recording medium by ejecting ink from the recording head, and is used to include an apparatus which ejects liquid corresponding to the application instead of ink from a liquid ejecting head corresponding to the ink jet type recording head on a medium to be ejected corresponding to the recording medium to adhere the liquid on the medium to be ejected.

As the liquid ejecting head, besides the recording head, there are included a color material ejecting head used for manufacture of a color filter such as a liquid crystal display, an electrode material (conductive paste) ejecting head used for manufacture of an electrode such as an organic EL display or field emission display (FED), a bioorganic material ejecting head used for manufacture of a biochip, a sample ejecting head as a minute pipette, and the like.

2. Related Art

A printer is an example of the recording device or the liquid ejecting apparatus. There is a printer which includes a recording head, transporting means provided at the upstream side of the recording head and for transporting a recording paper as an example of a recording medium or a medium to be ejected at the downstream side, and discharge means provide at the downstream side of the recording head and for discharging a recording paper on which recording is performed. Then, the transporting means is generally equipped with a transport driving roller rotatably driven and a transport driven roller that can be driven to rotate for nipping a recording medium between with the transport driving roller.

Herein, when printing is performed on the printing paper without making a white space, that is, when performing no frame print, the accuracy of paper feeding is reduced when the back end of the recording paper is passed between the transport driving roller and the transport driven roller (nip point). As a result, there is a case in that the recording quality is deteriorated. Consequently, in order to solve such a conventional problem, a printing device has been developed in which paper transporting speed is set to a low speed when the back end of the recording paper is passed through the nip point of the transport driving roller and the transport driven roller (see Patent Document 1)

However, in the printing device described in Patent Document 1, the problem that the paper transport amount is reduced is unavoidable when the back end of the recording paper is passed through the nip point of the transport driving roller and the transport driven roller. FIG. 8 is a side view of the paper transport pathway for illustrating the problem. Reference numeral 30 denotes a transport driving roller, reference numeral 31 denotes a transport driven roller, reference numeral 30*a* denotes a rotation axis line position of the transport driving roller 30, reference numeral 31*a* denotes a rotation axis line position of the transport driven roller 31.

Further, reference numeral H denotes a straight line parallel to the paper transport direction when viewed from the paper transport pathway, reference numeral V denotes a straight line perpendicular to the paper transport direction (straight line H), reference numeral R denotes a straight line passing the rotation axis line positions 30*a*, 31*a*, and reference numeral $\alpha$ denotes an angle made by the straight line V and the straight line R. Further, in the coordination system of the drawing, the Y direction denotes paper transport direction and the X direction denotes paper width direction. Note that, the "paper transport direction" denotes the direction in which recording paper should be transported and, for example, is the direction parallel to the head surface of a recording head (omitted in the drawing) provided at the downstream side (right direction in the drawing) of the transport driving roller 30.

Accordingly, when the angle $\alpha$ is not zero, the direction of the paper fed by the transport driving roller 30 and the transport driven roller 31 is not precisely in parallel to the paper transport direction. Then, when a paper guide member (not shown) for supporting recording paper from the lower side is provided at the position opposing the recording head, the angle $\alpha$ is set to a predetermined value (not zero) as shown in the drawing in order to prevent the recording paper to float from the paper guide member and to uniform the distance between the recording surface and the recording head.

Herein, even when a predetermined angle $\alpha$ is set as described above, the recording paper is transported to the downstream side by the outer circumference length of the transport driving roller 30 corresponding to the rotation angle of the transport driving roller 30 during the recording paper is nipped by the transport driving roller 30 and the transport driven roller 31 (the paper shown by the reference numeral $P_1$).

However, when the paper back end is passed through the nip point of the transport driving roller 30 and the transport driven roller 31 (the paper shown by the reference numeral $P_2$), the paper back end is pushed out along the outer circumference of the transport driving roller 30 while the posture of the paper back end becomes close to parallel to the paper transport direction. Consequently, the proceed amount of the paper back end in the Y direction becomes the Y direction component corresponding to the rotation angle $\beta$ of the transport driving roller 30. That is, the paper back end is not transported by the outer circumference length of the transport driving roller 30 corresponding to the rotation angle $\beta$ of the transport driving roller 30, so that transport loss occurs.

Note that, even when the downstream side of the paper is pulled by a discharge roller not shown provided at the downstream side of the transport driving roller 30, the paper back end is sandwiched and held between the transport driving roller 30 and the transport driven roller 31 when the paper back end is passed through the nip point of the transport driving roller 30 and the transport driven roller 31. Accordingly, the paper transport amount depends on the transport driving roller 30 and the paper transport accuracy is deteriorated as described above.

Then, the deterioration of recording quality caused by the deterioration of the paper transport accuracy (occurrence of transport loss) when the paper back end is passed through the nip point of the transport driving roller 30 and the transport driven roller 31 as described above is not considered in the above described conventional technique. Consequently, it has been impossible to solve the problem.

Note that, in Japanese Patent No. 3142147, a technique for displacing the contact position of a paper push roller on the circumference surface of a paper feed roller. In the technique, the contact area of a recording paper and the paper feed roller can be adjusted and occurrence of skew caused by the paper feed roller can be prevented by increasing the frictional contact force between the paper and the circumference surface of the paper feed roller by increasing the contact area. However, the above described problem of the invention is not described and not suggested.

SUMMARY

The invention is made in the light of such a problem and the object is to prevent the deterioration of paper feed accuracy, in particular, the occurrence of transport loss when the back end of a recording paper is passed between a transport driving roller and a transport driven roller (nip point).

In order to solve the above problem, according to a first aspect of the invention, there is provided a recording medium transport device that includes a transport driving roller rotatably driven, a transport driven roller that can be driven to rotate for nipping a recording medium between with the transport driving roller, a driven roller supporting member for pivotally supporting the transport driven roller and provided so as to be able to be displaced, adjust means for adjusting the angle $\alpha$ made by a straight line passing the rotation axis line position of the transport driving roller and the rotation axis line position of the transport driven roller and a straight line parallel to the gravity direction, and control means for reducing the angle $\alpha$ by controlling the adjust means before the back end of a recording medium is passed through the nip point of the transport driving roller and the transport driven roller based on the information from detecting means for detecting the position of the recording medium on the transport pathway.

According to the aspect, the angle $\alpha$ is reduced by the adjust means before the back end of the recording medium is passed through the nip point of the transport driving roller and the transport driven roller, so that the difference of a recording medium transport amount with respect to a predetermined rotation amount of the transport driving roller becomes small before and after the back end of the recording medium is passed through the nip point of the transport driving roller and the transport driven roller. Consequently, the deterioration of transport accuracy (occurrence of transport loss) when the back end the recording medium is passed through the nip point of the transport driving roller and the transport driven roller can be prevented.

According to a second aspect of the invention, there is provided a recording medium transport device in which the control means sets the angle $\alpha$ to zero by controlling the adjust means before the back end of the recording medium is passed through the nip point of the transport driving roller and the transport driven roller in the recording medium transport device according to the first aspect.

According to the aspect, the adjust means sets the angle $\alpha$ to zero before the back end of the recording medium is passed through the nip point of the transport driving roller and the transport driven roller, so that the difference of a recording medium transport amount with respect to a predetermined rotation amount of the transport driving roller becomes further small before and after the back end of the recording medium is passed through the nip point of the transport driving roller and the transport driven roller. Consequently, the occurrence of transport loss when the back end of the recording medium is passed through the nip point of the transport driving roller and the transport driven roller can be more surely prevented.

According to a third aspect of the invention, there is provided a recording medium transport device in which the control means sets a transition segment before and after the timing when the back end of the recording medium is passed through the nip point of the transport driving roller and the transport driven roller figured out based on the information from the detecting means, and switches the set value of the angle $\alpha$ from $\alpha_1$ to $\alpha_2$ in a stepwise fashion in the transition segment when the value of the angle $\alpha$ before the back end of the recording medium is passed through the nip point of the transport driving roller and transport driven roller is set to $\alpha_1$ and the value of the angle $\alpha$ after the back end of the recording medium is passed through the nip point of the transport driving roller and transport driven roller is set to $\alpha_2$ in the recording medium transport device according to the first or second aspect.

There is a case that the timing when the back end of the recording medium is actually passed through the nip point of the transport driving roller and the transport driven roller is not matched to the theoretical (design) timing figured out by the control means. In such a case, the back end of the recording medium may pass through the nip point of the transport driving roller and the transport driven roller before the angle $\alpha$ is reduced by the control means. Accordingly, the operation and effect of the first aspect of the invention may be not obtained.

Consequently, in the aspect, a transition segment is set before and after the timing when the back end of the recording medium is passed through the nip point of the transport driving roller and the transport driven roller figured out by the control means and the set value of the angle $\alpha$ is switched from $\alpha_1$ to $\alpha_2$ in a stepwise fashion in the transition segment. Accordingly, even when the timing when the back end of the recording medium is actually passed between the transport driving roller and the transport driven roller is not matched to the timing figured out by the control means, the angle $\alpha$ is already changed to an appropriate angle when the back end of the recording medium is passed between the transport driving roller and the transport driven roller. This enables to reduce transport loss when the back end of the recording medium is passed through the nip point of the transport driving roller and the transport driven roller.

According to a fourth aspect of the invention, there is provided a recording medium transport device in which the control means adjusts the angle $\alpha$ in accordance with the type of the recording medium in the recording medium transport device according to any of the first to third aspects.

According to the aspect, the control means adjusts the angle $\alpha$ in accordance with the type of the recording medium, so that the posture when the recording medium is nipped by the transport driving roller and the transport driven roller can be adjusted to an appropriate posture in accordance with the thickness/stiffness of the recording medium.

According to a fifth aspect of the invention, there is provided a recording device that includes recording means for performing recording on a recording medium and the recording medium transport device according to any of the first to fourth aspects. According to the aspect, the operation and effect similar to those of the invention according to the first to fourth aspects can be obtained in the recording device.

According to a sixth aspect of the invention, there is provided a liquid ejecting apparatus that includes liquid ejecting means for performing liquid ejection on a medium to be ejected, a transport driving roller rotatably driven, a transport driven roller that can be driven to rotate for nipping a medium to be ejected between with the transport driving roller, a driven roller supporting member for pivotally supporting the transport driven roller and provided so as to be able to be displaced, adjust means for adjusting the angle $\alpha$ made by a straight line passing the rotation axis line position of the transport driving roller and the rotation axis line position of the transport driven roller and a straight line parallel to the gravity direction, and control means for reducing the angle α by controlling the adjust means before the back end of a medium to be ejected is passed through the nip point of the transport driving roller and the transport driven roller based on the information from detecting means for detecting the position of the medium to be ejected on the transport pathway.

DESCRIPTION OF EXEMPLARY EMBODIMENTS

Figure 1:
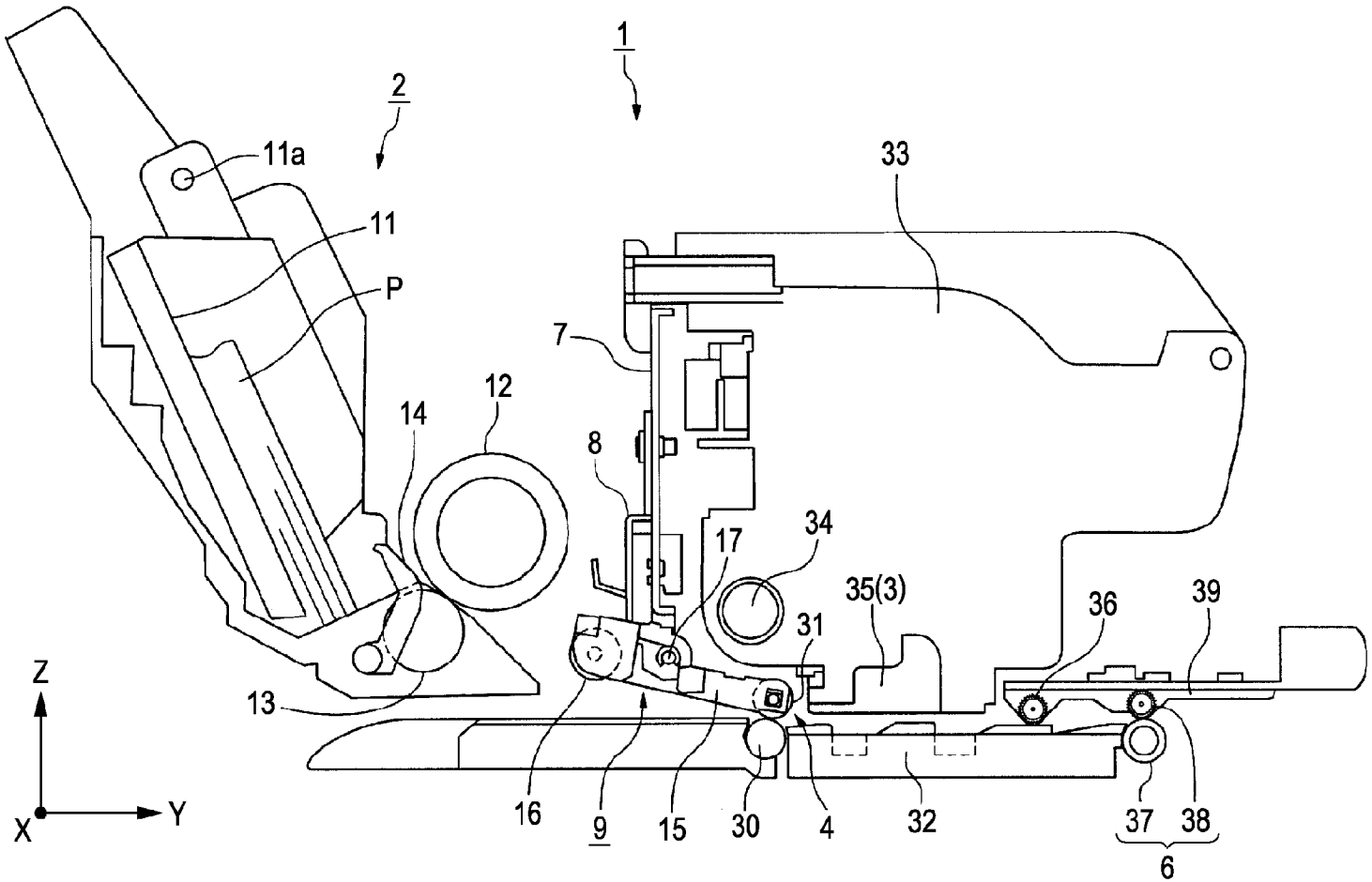
FIG. 1 This is a sectional side view of the device main body of a printer according to the invention.
Figure 2:
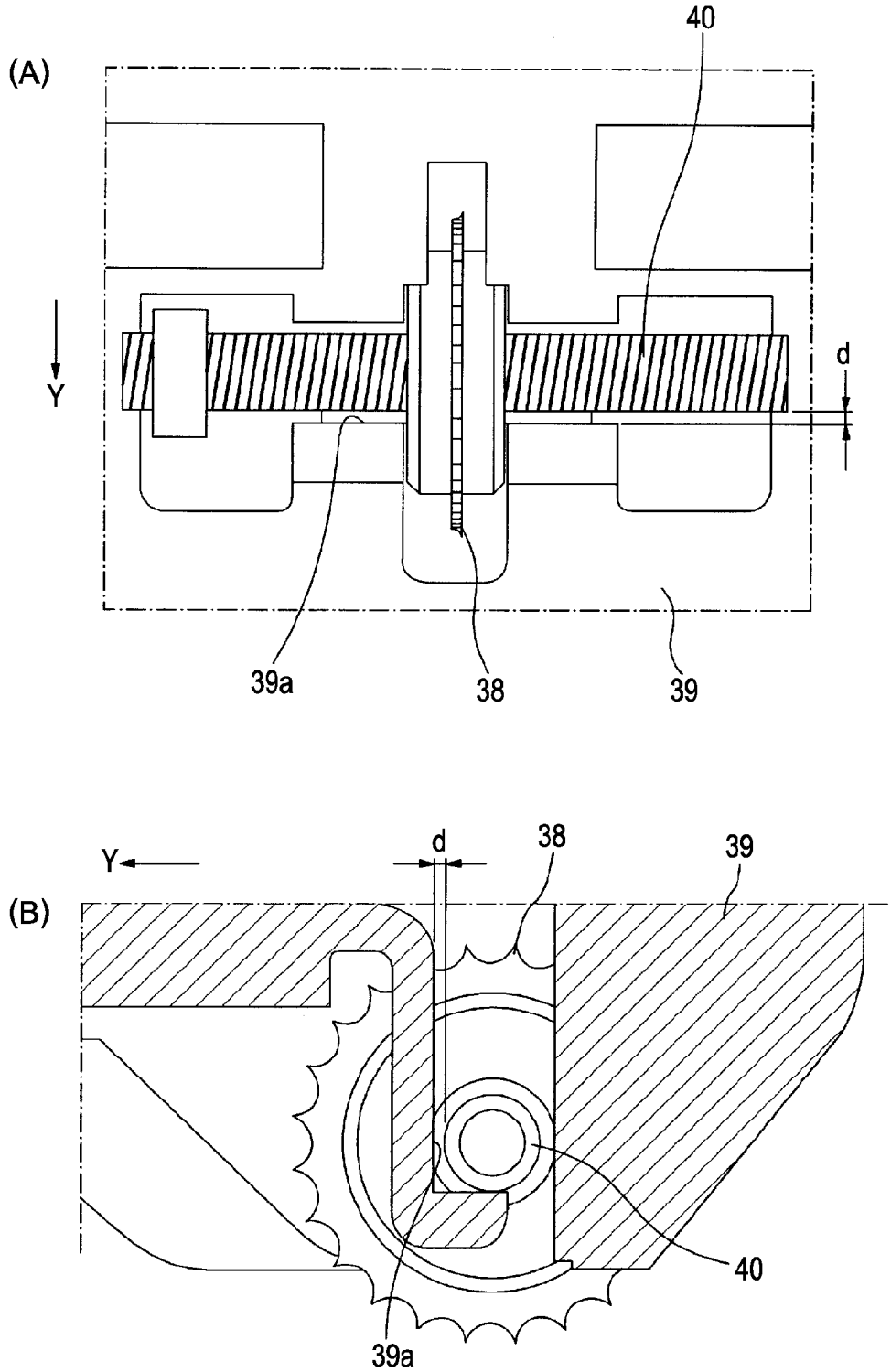
FIG. 2 (A) is a plan view of an attachment portion of a discharge driven roller, (B) is a sectional side view of the attachment portion.
Figure 3:
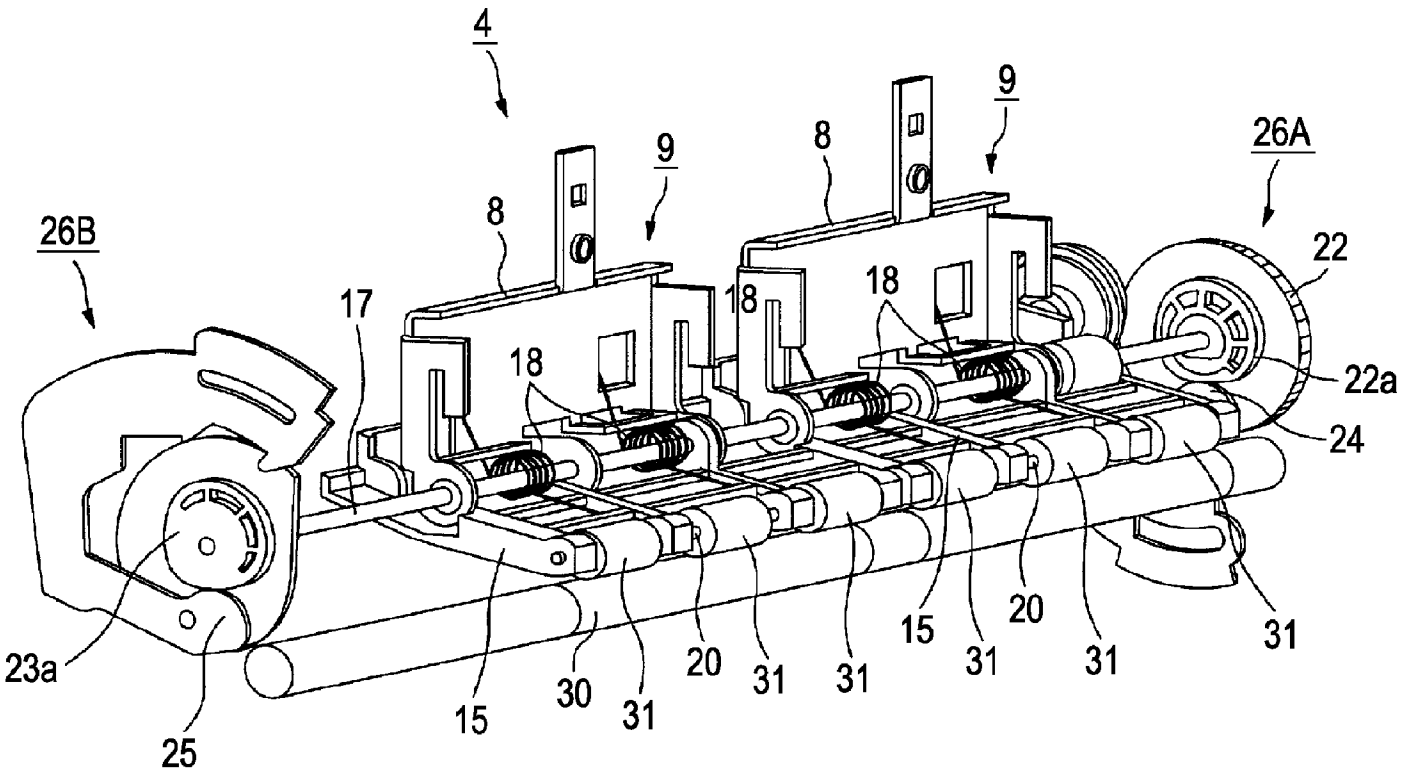
FIG. 3 This is a perspective view of transport means according to the invention.
Figure 4:
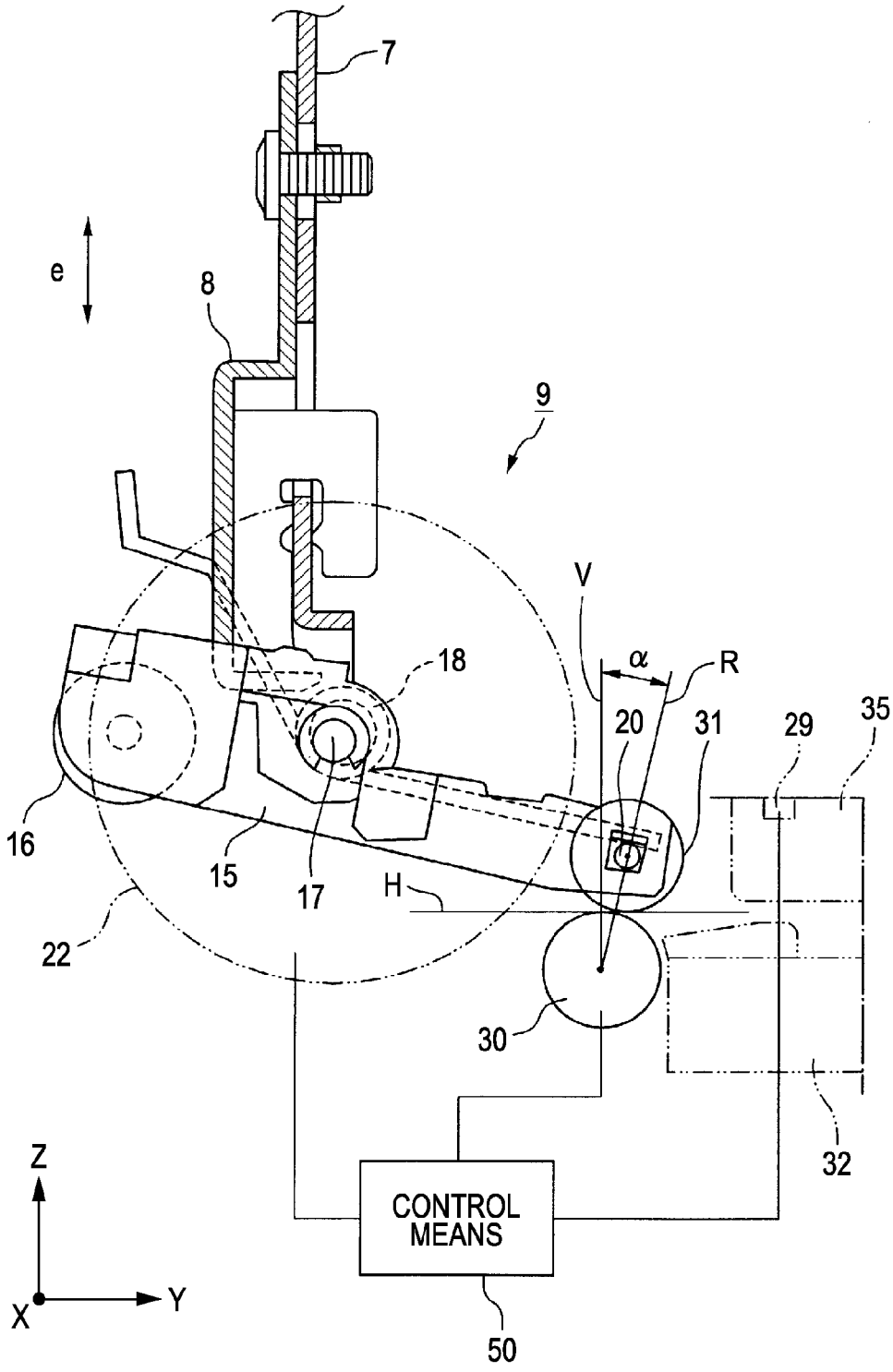
FIG. 4 This is a side view of a paper guide up unit and a block diagram of a control system.
Figure 5:
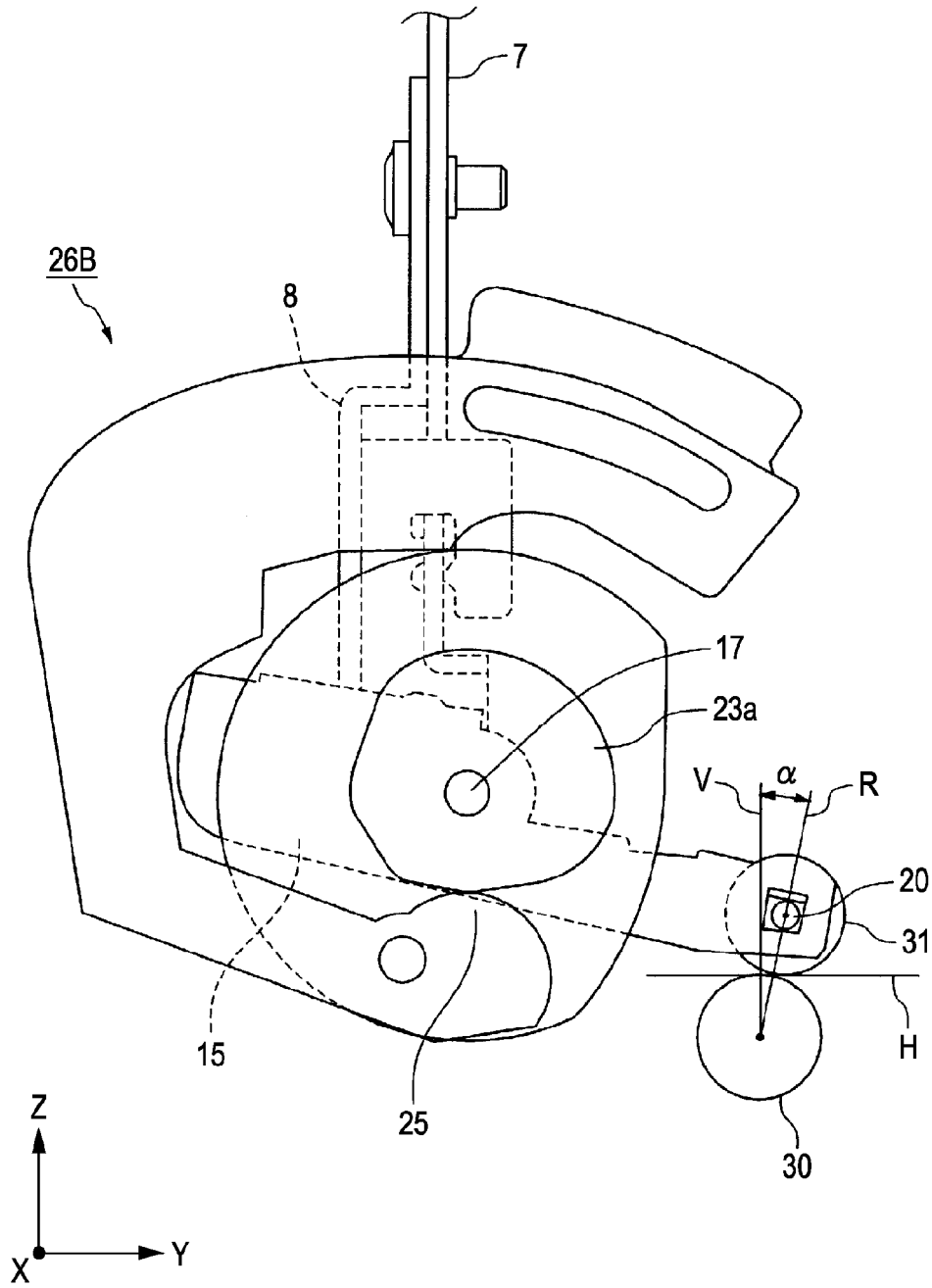
FIG. 5 This is a side view of adjusting means for adjusting the angle α.
Figure 6:
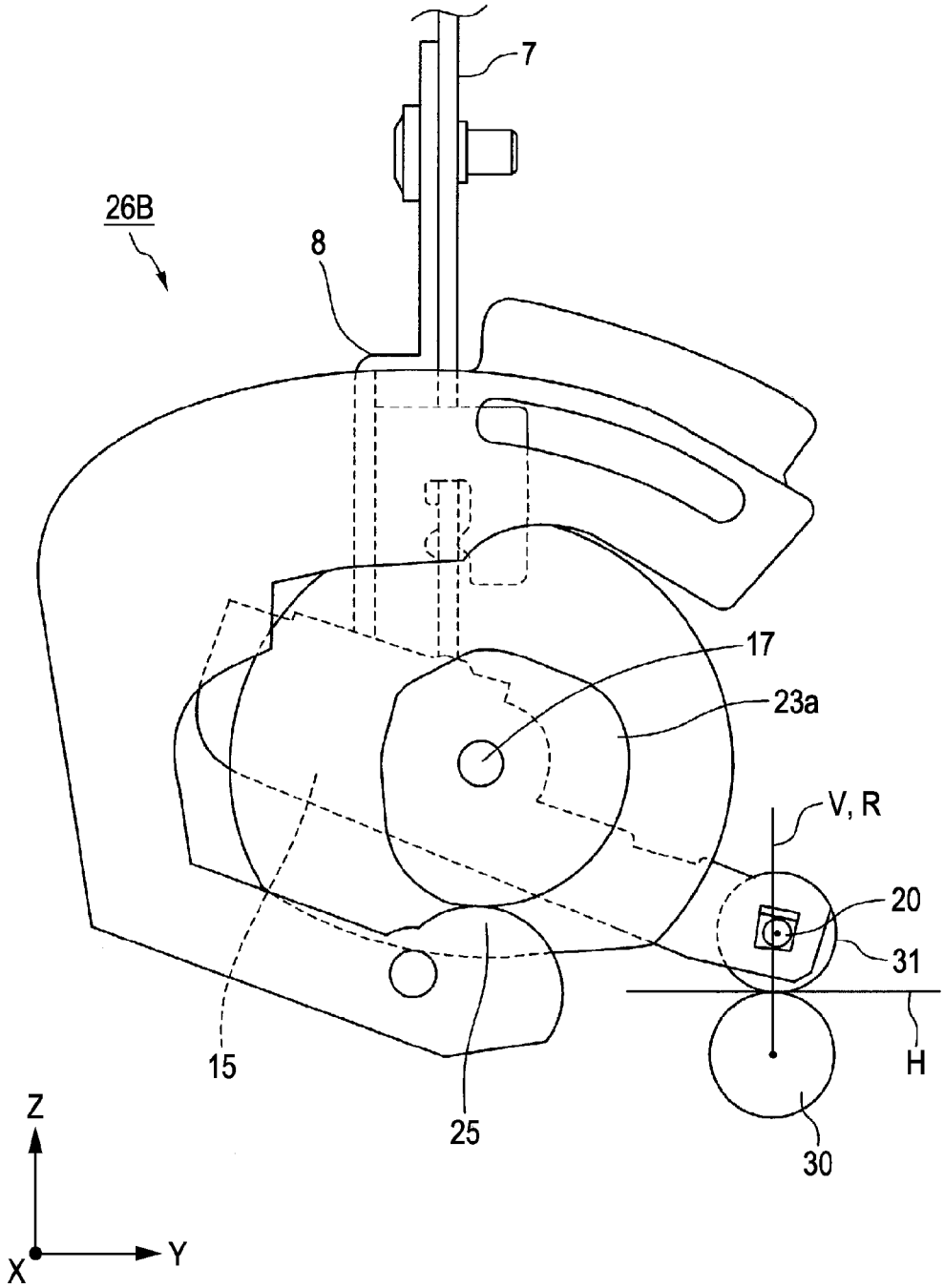
FIG. 6 This is a side view of adjusting means for adjusting the angle α.
Figure 7:
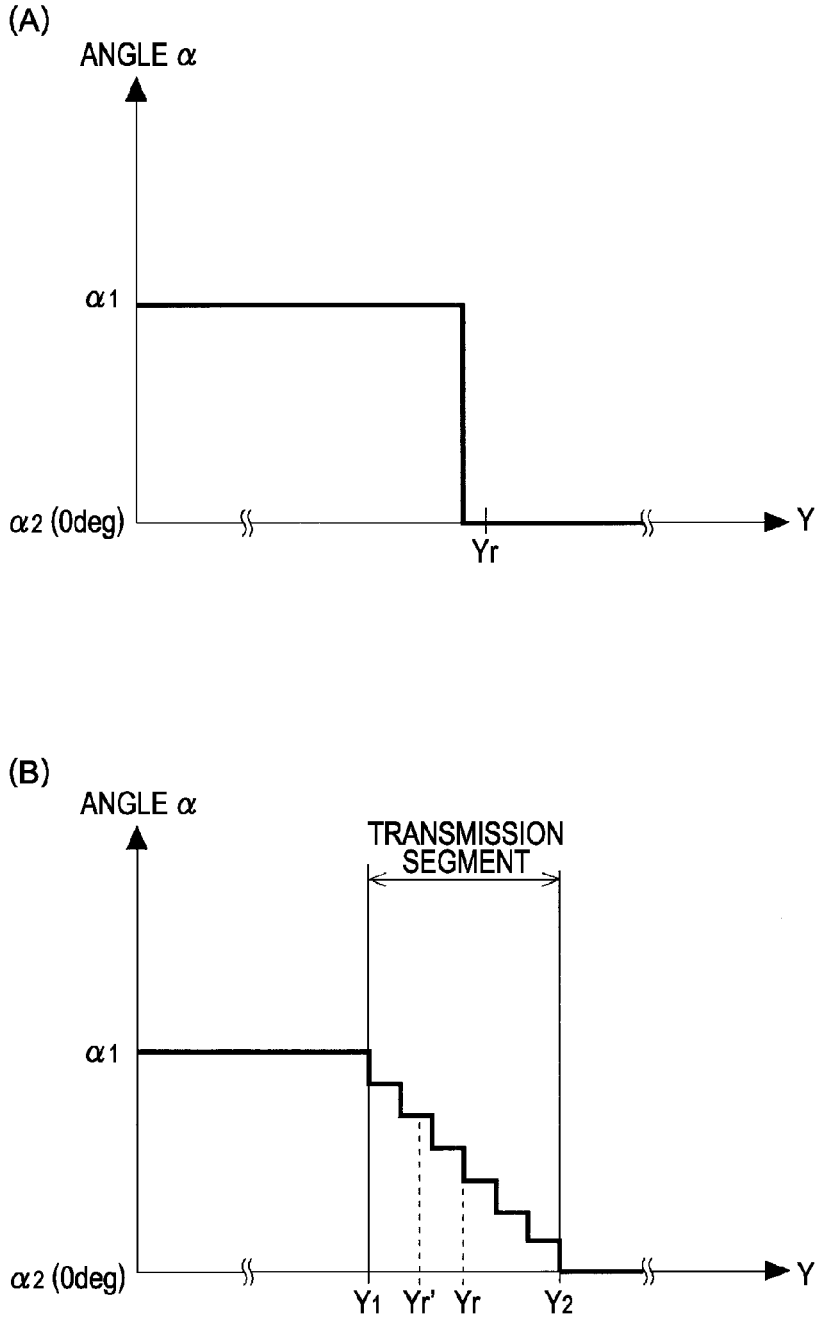
FIG. 7 Both of (A) and (B) are diagrams showing change of the set value of the angle α.

Hereinafter, an embodiment of the invention will be described with reference to FIG. 1 to FIG. 7. FIG. 1 is a sectional side view of an ink jet printer (hereinafter, referred to as a "printer") according to an embodiment of a "recording device" or "liquid ejecting device" of the invention, FIG. 2(A) is a plan view of an attachment portion of a discharge driven roller 38, FIG. 2B is a sectional side view of the attachment portion, FIG. 3 is a perspective view of transport means as a "recording medium transport device" of the invention, FIG. 4 is a side view of a paper guide up unit 9 (including a block diagram of a control system), FIG. 5 and FIG. 6 are each a side view of adjust means 26B, FIGS. 7(A), 7(B) are diagrams showing change of a set value of an angle α. Note that, in the coordinate system shown in FIG. 1 and FIGS. 4 to 6, the Y direction shows paper transport direction, the X direction shows paper width direction, and the Z direction shows the direction perpendicular to the X direction and the Y direction similarly to those described with reference to FIG. 8.

Hereinafter, first, a printer 1 will be schematically described with reference to FIGS. 1 to 2. Note that, the right direction (printer front side) of FIG. 1 shall be referred to as the "downstream side" of the paper feed pathway and the left direction of FIG. 1 shall be referred to as the "upstream side" thereof.

The printer 1 is equipped with a feeding device 2 on which a recording paper (mainly a single sheet paper: hereinafter, referred to as a "paper P") as an example of a "recording medium" and "medium to be ejected" can be set in a leaning posture. The paper P is fed from the paper feeding device 2 towered transport means 4 at the downstream side. The fed paper P is fed to the downstream side by the transport means 4 or discharge means 6, or by the cooperative operation of the transport means 4 and the discharge means 6, and recording is performed by a recording head 36 (recording means 3). Then, the paper P on which recording is performed by the recording head 36 is discharged in the front direction of the device by discharge means 6 provided at the downstream side.

Hereinafter, the detail will be further described. The feeding device 2 is equipped with a hopper 11, a feeding roller 12, a retard roller 13, and a return lever 14. The hopper 11 is formed by a plate body and provided so as to be able to slide around a sliding supporting point 12*a* of an upper portion. The hopper 11 is switched between a contact posture in which the paper P supported on the hopper 11 in an inclining posture is made contact with the feeding roller 12 and a disengaged posture in which the paper P is disengaged from the feeding roller 12 by sliding. The retard roller 13 prevents multi feeding of the paper P by forming a nip point between with the feeding roller 12. The return lever 14 returns the following papers P which is about to be multi fed on the holler 11 by sliding.

The transport means 4 is equipped with a transport driving roller 30 rotatably driven by a motor not shown and a transport driven roller 31 driven to rotate by making contact with the transport driving roller 30. The transport driving roller 30 is formed by an axis body extending in the paper width direction (main scanning direction: X direction) and a plurality (six in the embodiment) of the transport driven rollers 31 are provided in the axis line direction of the transport driving roller 30 (see FIG. 3).

A paper guide units 9 constitutes the transport means 4 and supports the transport driven roller 31. Two of the paper guide units 9 are provided in parallel in the paper width direction in the embodiment as shown in FIG. 3. One of the paper guide unit 9 is equipped with a sub frame 8, a paper guide up 15 as a "driven roller supporting member", an axis 17, two coil springs 18, the three transport driven rollers 31, and a rotation axis 20 which becomes the rotation axis of the transport driven rollers 31. The paper guide up unit 9 as a unit body is constituted by assembling the constituent elements.

The paper guide up 15 is provided so as to be able to be slid with respect to a sub frame 8 via the axis 17. Then, the paper guide up 15 is provided so as to be able to be slid when viewed from the paper transport pathway side by attaching the sub frame 8 to a main frame 7. The axis 17 is inserted through the coil portion of the two coil springs 18 and a bias force is generated between the sub frame 8 and the paper guide up 15 by the two coil springs 18, thereby the transport driven roller 31 is made contact with the transport driving roller 30. Note that the paper guide up unit 9 (paper guide up 15) is constituted to be able to be displaced in the up and down direction (Z direction). This point will be described below in detail.

Return to FIG. 1, the paper P reached the transport driving roller 30 is fed to the sub scanting direction at the downstream side by the rotation of the transport driving roller 30 in the state nipped by the transport driving roller 30 and the transport driven roller 31. Note that a guide roller 16 provided between the feeding device 2 and the transport driving roller 30 forms a feeding posture of the paper P prevents the paper P to make contact with the feeding roller 12 to reduce transport load.

An ink jet recording head (hereinafter, referred to as "recording head") 35 and a paper guide front 32 arranged so as to be opposed to the recording head 35 are provided at the down stream side of the transport driving roller 30. The recording head 35 is provided at the bottom of a carriage 33. The carriage 33 is driven so as to be moved back and forth in the main scanning direction by a driving motor not shown while being guided by a carriage guide axis 34 extending in the main scanning direction. The paper guide front 32 sets the distance between the paper P and the recording head 35 by supporting the paper P from the lower direction. Pluralities of ribs are formed on the surface opposing the recording head 35 in the paper guide front 32. The paper P is supported by the ribs from the lower direction.

Subsequently, an auxiliary roller 36 and discharge means 6 are provided at the downstream side of the recording head 35. The discharge means 6 is equipped with a discharge driving roller 37 rotated by the power transmitted from a motor not shown and a discharge driven roller 38 driven to rotate by making contact with the discharge driving roller 37. A plurality of discharge driving rollers 37 and a plurality of discharge driven rollers 38 are provided in the paper width direction in the discharge means 6.

The discharge driven roller 38 has an elastic axis (for example, bar spring) 40 as a rotation axis as shown in FIG. 2, and the rotation axis 40 is pivotally supported by a support member 39. Herein, the arrow Y shows the paper feeding direction in FIG. 2, and the reference numeral 39*a* denotes a regulation surface for regulating the position of the elastic axis 40. When the elastic axis 40 is strongly made contact with the regulation surface 39*a* with paper feeding, the force of the discharge driven roller 38 made contact with the discharge driving roller 37 becomes uneven in the paper width direction by the frictional force. This may cause skew. Accordingly, a predetermined gap is formed between the elastic axis 40 and the regulation surface 39*a* as shown by the reference numeral d in the drawing.

Return to FIG. 1, the paper P on which recording is performed by the recording head 36 is discharged toward a stacker not shown arranged in the front direction of the device by the discharge driving roller 37 and the discharge driven roller 38. Note that the auxiliary roller 36 prevents floating of the paper P from the paper guide front 32 to keep the distance between the paper P and the recording head 35 to a constant distance.

Note that, the printer 1 is constituted so as to be able to perform so called non frame printing in which white space is not made at the upper edge and the lower edge of the paper P. When the non frame printing is performed at the upper edge of the paper P, the upper end of the paper P does not reach the discharge driving roller 37, so that the paper P receives a feeding force only from the transport driving roller 30. Then, when the upper end of the paper P reaches the discharge driving roller 37, the paper P receives a feeding force from the both of the transport driving roller 30 and the discharge driving roller 37. Then, when the lower end of the paper P is passed through the transport driving roller 30, the paper P receives a feeding force only from the discharge driving roller 37. In this manner, in the non frame printing, the roller which dominates the feeding accuracy of the paper P is switched in accordance with the position of the paper P in the feeding direction.

The structure of the printer 1 is schematically described above. Hereinafter, the transport means 4 as a recording medium transport device will be described in detail.

As shown in FIG. 3, the transport means 4 is equipped with the transport driving roller 30, the two paper guide up units 9, adjust means 26A, 26B provided at the both sides thereof, and control means 50 (FIG. 4) for controlling the adjusting means 26A, 26B.

The two paper guide up units 9 are provided in parallel in the paper width direction in the embodiment as shown in FIG. 3. However, the axis 17 is one axis body which is common for the two paper guide up units 9. The adjust means 26A is provided at the end at one side and adjust means 26B is provided at the end at the other side. The paper guide up unit 9 (paper guide up 15) is displaced in the upper and lower direction by the adjust means 26A, 26B.

The adjust means 26A is equipped with a cam gear 22, a cam follower 22*a*, and a cam 24, and the adjust means 26B is equipped with a cam follower 23*a* and a cam 25.

The cam gear 22 and the cam follower 22*a* are integrally formed and attached to an end of the axis 17. The power of a motor not shown is transmitted to the cam gear 22 and cam follower 22*a* is rotated by the power. Herewith, the axis 17 and the cam follower 23*a* attached to the edge opposite to the cam follower 22*a* is also rotated.

The cam 24 is provided to the cam follower 22*a* and the cam 25 is provided to the cam follower 23 so as to be able to be engaged thereto. The cam 24 and the cam 25 are fixedly provided to the frame of the device not shown. On the other hand, the axis 17 and two sub frames 8 (paper guide up unit 9) through which the axis 17 is inserted are provided so as to be able to be slid with respect to the main frame 7. Accordingly, the axis 17 and the paper guide up unit 9 are displaced in the direction shown by the arrow e of FIG. 4 (Z direction) with the rotation of the cam followers 22*a*, 23*a*.

The control means shown by the reference numeral 50 of FIG. 4 is means for controlling a motor not shown for transmitting power to the cam gear 22. Further, the control means 50 controls a motor not shown for driving the transport driving roller 30 based on the information from a sensor 29 as detecting means for detecting a position (Y direction position) on the paper transport pathway. The sensor 29 is an optical sensor provided, for example, at the bottom surface of the carriage 33. By detecting the change of the intensity of the reflection light caused by passage of paper, the control means 50 can detect the passage of the paper front end or back end.

Figure 8:
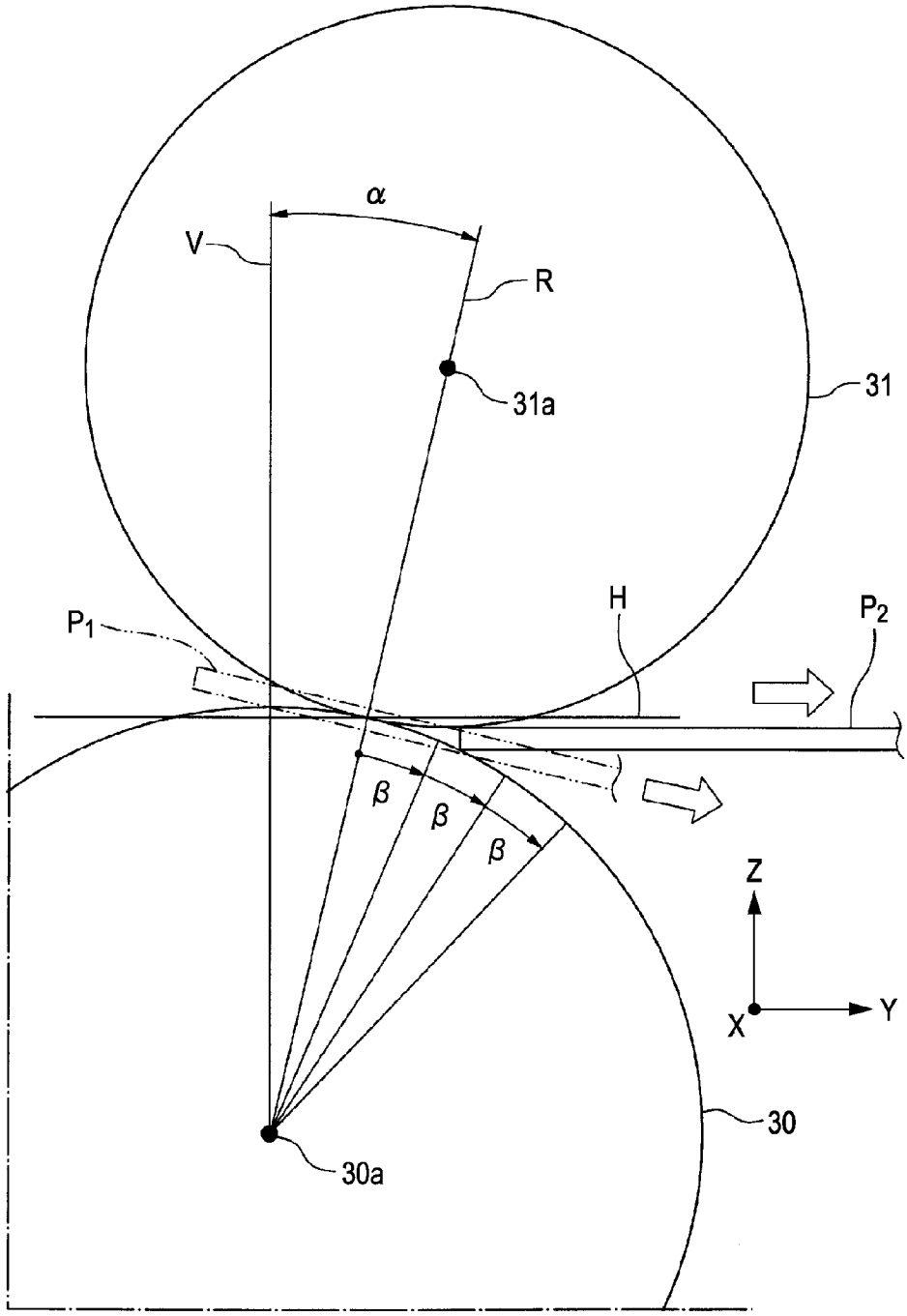
FIG. 8 This is a side view of paper transport pathway in order to illustrate the problem of the invention.

Note that, the straight lines shown by the reference numerals H, R, and V and the angle shown by the reference numeral $\alpha$ in FIG. 4 are the same as those shown in FIG. 8. Specifically, the reference numeral H denotes a straight line parallel to the head surface of the recording head 35 when viewed from the paper transport pathway side (that is, a straight line parallel to the direction in which the paper should be transported (the horizontal direction in the embodiment)), the reference numeral V denotes a straight line perpendicular to the paper transport direction (straight line parallel to the gravity direction in the embodiment), the reference numeral R denotes a straight line passing a rotation axis line position 30*a* (FIG. 8) of the transport driving roller 30 and a rotation axis line position 31*a* (FIG. 8) of the transport driven roller 31 when viewed from the paper transport pathway side, and the reference numeral $\alpha$ denotes an angle made by the straight line V and the straight line R.

Incidentally, when the axis 17 (paper guide up unit 9) is displaced in the direction shown by the arrow e in FIG. 4, the rotation axis 20 of the transport driven roller 31 is displaced in the upstream side direction or the downstream side direction (Y direction) with the displacement. As a result, the angle $\alpha$ is changed. For example, when the cam follower 23*a* is rotated by 90 degrees in clockwise direction of the drawing from the state shown in FIG. 5, the axis 17 (paper guide up unit 9) is displaced in the upper direction as shown in FIG. 6. With the displacement, the rotation axis 20 of the transport driven roller 31 is displaced in the upstream side direction and the angle $\alpha$ is changed as shown by the change from FIG. 5 to FIG. 6 (note that, FIG. 6 shows the state where the angle $\alpha$ becomes zero (the straight line V and the straight line R are in parallel).

The control unit 50 adjusts the angle $\alpha$ by controlling the adjust means 26A, 26B (hereinafter, referred to as "adjust means 26" when no distinction is required) in this manner. The adjustment of the angle $\alpha$ is performed before and after the back end of the paper is passed through the nip pint of the transport driving roller 30 and the transport driven roller 31. In FIGS. 7(A), 7(B), the horizontal axis denotes a Y direction position and the longitudinal axis denotes a set value of the angle $\alpha$ corresponding to the Y direction position of the paper back end. Further, the reference numeral $Y_r$ denotes a logical (design) nip point position of the transport driving roller 30 and the transport driven roller 31 figured out by the control means 50.

For example, as shown in FIG. 7(A), the control means 50 reduces the angle $\alpha$ ($\alpha_1 \rightarrow \alpha_2$) by controlling the adjust means 26 before performing paper feed operation by which the paper back end is passed through the nip position (position $Y_r$) of the transport driving roller 30 and the transport driven roller 31 base on the information from the sensor 29. Herewith, the advance amount of the paper back end when passing through the nip point of the transport driving roller 30 and the transport driven roller 31 comes further close to the outer circumference length corresponding to a predetermined rotation angle of the transport driving roller 30.

As a result, the difference of the paper transport amount with respect to a predetermined rotation amount of the transport driving roller 30 becomes small before and after the paper back end is passed through the nip point of the transport driving roller 30 and the transport driven roller 31. Consequently, the deterioration of the transport accuracy (occurrence of transport loss) when the paper back end is passed through the nip point of the transport driving roller 30 and the transport driven roller 31 can be prevented. In particular, in the embodiment shown in FIG. 6 and FIG. 7, the angle $\alpha_2$ is set to zero. Accordingly, the advanced amount of the paper back end when the paper back end is passed through the nip point of the transport driving roller 30 and the transport driven roller 31 becomes further close to the outer circumference length corresponding to a predetermined rotation angle of the transport driving roller 30, so that the transport loss can be further reduced.

Herein, there is a case that the timing when the paper back end is actually passed through the nip point of the transport driving roller 30 and the transport driven roller 31 is not matched to the theoretical (design) timing figured out by the control means 50. In such a case, the paper back end may pass through the nip point of the transport driving roller 30 and the transport driven roller 31 before the angle $\alpha$ is reduced by the control means 50.

Consequently, a transition segment may be set before and after the theoretical timing when the paper back end is passed through the nip point of the transport driving roller 30 and the transport driven roller 31 and the set value of the angle $\alpha$ may be switched from $\alpha_1$ to $\alpha_2$ in a stepwise fashion in the transition segment. In FIG. 7(B), the reference numeral $Y_1$ denotes the start position of the transition segment and the reference numeral $Y_2$ denotes the finish position of the transition segment. The set value of the angle $\alpha$ is switched from $\alpha_1$ to $\alpha_2$ in a stepwise fashion from the start position $Y_1$ to the finish position $Y_2$ as shown in the drawing.

Herewith, even when the timing (position on the Y coordinate) when the paper back end is actually passed between the transport driving roller 30 and the transport driven roller 31 is not matched to the theoretical timing (position $Y_r$ on the Y coordinate) figured out by the control means 50, for example, as shown by the reference numeral $Y_r'$, the angle is already changed to an angle smaller than $\alpha$ when the paper back end is passed through the nip point of the transport driving roller 30 and the transport driven roller 31. This enables to reduce transport loss when the paper back end is passed through the nip point of the transport driving roller 30 and the transport driven roller 31.

Since the control means 50 can adjust the angle $\alpha$ as described above, the angle $\alpha$ ($\alpha_1$ of FIGS. 7(A), 7(B)) when nipping the paper P by the transport driving roller 30 and the transport driven roller 31 can be adjusted in accordance with the type of the paper. For example, when the paper stiffness of a glossy paper or the like is high, increase of the transport load caused by the paper strongly making contact with the paper guide front 32 can be prevented by setting the angle $\alpha_1$ to a small value. When the paper stiffness of a normal paper or the like is low, floating of the paper can be further surely prevented by strong contact of the paper with respect to the paper guide front 32. In addition, a further preferable recording result can be obtained as the angle $\alpha$ can be adjusted in accordance with the position of the paper on the transport pathway, the using circumstance, and the like.

The disclosure of Japanese Patent Application No. 2006-331564 filed Dec. 8, 2006 including specification, drawings and claims is incorporated herein by reference in its entirety.

What is claimed is:

1. A recording medium transport device, comprising:

a transport driving roller rotatably driven;

a transport driven roller that can be driven to rotate for nipping a recording medium between with the transport driving roller;

a driven roller supporting member for pivotally supporting the transport driven roller and provided so as to be able to be displaced;

adjusting member for adjusting the angle $\alpha$ made by a straight line passing the rotation axis line position of the transport driving roller and the rotation axis line position of the transport driven roller and a straight line parallel to the gravity direction; and controlling member for reducing the angle $\alpha$ by controlling the adjusting member after a leading edge of the recording medium has passed through the nip point and before the back end of the recording medium is passed through the nip point of the transport driving roller and the transport driven roller based on the information from detecting member for detecting the position of the recording medium on the transport pathway.

2. The recording medium transport device according to claim 1, wherein the controlling member sets the angle $\alpha$ to zero by controlling the adjusting member before the back end of the recording medium is passed through the nip point of the transport driving roller and the transport driven roller.

3. The recording medium transport device according to claim 1, wherein the controlling member sets a transition segment before and after the timing when the back end of the recording medium is passed through the nip point of the transport driving roller and the transport driven roller figured out based on the information from the detecting member, and switches the set value of the angle $\alpha$ from $\alpha_1$ to $\alpha_2$ in a stepwise fashion in the transition segment when the value of the angle $\alpha$ before the back end of the recording medium is passed through the nip point of the transport driving roller and transport driven roller is set to $\alpha_1$ and the value of the angle $\alpha$ after the back end of the recording medium is passed through the nip point of the transport driving roller and transport driven roller is set to $\alpha_2$.

4. The recording medium transport device according to claim 1, wherein the controlling member adjusts the angle $\alpha$ in accordance with the type of the recording medium.

5. A recording device, comprising:

recording member for performing recording on a recording medium; and the recording medium transport device according to claim 1.

6. A liquid ejecting apparatus, comprising:

liquid ejecting member for performing liquid ejection on a medium to be ejected;

a transport driving roller rotatably driven;

a transport driven roller that can be driven to rotate for nipping a medium to be ejected between with the transport driving roller;

a driven roller supporting member for pivotally supporting the transport driven roller and provided so as to be able to be displaced;

adjusting member for adjusting the angle $\alpha$ made by a straight line passing the rotation axis line position of the transport driving roller and the rotation axis line position of the transport driven roller and a straight line parallel to the gravity direction; and controlling member for reducing the angle $\alpha$ by controlling the adjust means after a leading edge of the recording medium has passed through the nip point and before the back end of the medium to be ejected is passed through the nip point of the transport driving roller and the transport driven roller based on the information from detecting member for detecting the position of the medium to be ejected on the transport pathway.

* * * * *